US007353856B2

(12) United States Patent
Pon et al.

(10) Patent No.: US 7,353,856 B2
(45) Date of Patent: Apr. 8, 2008

(54) WINDOW COVERING HAVING ROLL-UP SHADE SEGMENTS

(75) Inventors: David Pon, Tustin, CA (US); Yu-Che Wen, Gueishan Town (TW); Tung Jung Chen, Lukang Town (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 365 days.

(21) Appl. No.: 11/187,541

(22) Filed: Jul. 22, 2005

(65) Prior Publication Data

US 2007/0017645 A1 Jan. 25, 2007

(51) Int. Cl.
*A47H 1/00* (2006.01)

(52) U.S. Cl. ..... 160/120; 160/166.1; 160/176.1 R; 160/84.01

(58) Field of Classification Search ..... 160/115, 160/116, 120, 168.1 R, 170, 176.1 R, 241, 160/243, 84.01, 166.1, 84.05, 178.3, 180, 160/236, 174 R
See application file for complete search history.

(56) References Cited

U.S. PATENT DOCUMENTS

| | | | | |
|---|---|---|---|---|
| 179,123 | A * | 6/1876 | McGill | 160/120 |
| 5,787,951 | A * | 8/1998 | Tonomura et al. | 160/84.01 |
| 5,829,506 | A | 11/1998 | Zorbas | |
| 6,808,001 | B2 * | 10/2004 | Jelic et al. | 160/120 |
| 6,860,310 | B2 * | 3/2005 | Kubly et al. | 160/122 |
| 6,860,312 | B2 | 3/2005 | Judkins | |
| 7,137,429 | B2 * | 11/2006 | Jelic | 160/120 |
| 7,252,132 | B2 * | 8/2007 | Nien et al. | 160/84.01 |
| 2004/0079492 | A1 * | 4/2004 | Lin | 160/84.01 |
| 2005/0006032 | A1 * | 1/2005 | Yu et al. | 160/84.01 |
| 2005/0006033 | A1 | 1/2005 | Yu et al. | |
| 2007/0175593 | A1 * | 8/2007 | Lin | 160/84.01 |

* cited by examiner

*Primary Examiner*—Blair M. Johnson
(74) *Attorney, Agent, or Firm*—Buchanan Ingersoll & Rooney PC

(57) ABSTRACT

A window covering has a plurality of shade elements, each having a first longitudinal edge and a second longitudinal edge. The shade elements are positioned sequentially below a headrail, and each shade element is made of a window covering material that can be rolled about the first longitudinal edge. A first rail extends from the headrail past the first longitudinal edge of each shade element and is connected to lowermost shade element or the bottom rail. A second rail extends from the headrail and is attached to lowermost shade element or the bottom rail and to the second longitudinal edge of each shade element. Rungs extend between the first rail and the second rail such that there is one rung below and corresponding to each shade element. The first longitudinal edge of each shade element rests upon a corresponding rung when the window covering is in a closed position. A control mechanism is connected to the first rail and is capable of moving the first rail relative to the second rail. Such relative movement causes each of the plurality of shade elements to roll or unroll about the first longitudinal edge of the shade element.

17 Claims, 6 Drawing Sheets

WINDOW COVERING HAVING ROLL-UP SHADE SEGMENTS

BACKGROUND OF THE INVENTION

1. Field of the Invention

The present invention relates generally to window blinds of the type having operable segments that can be moved between an open position and a closed position such as a venetian blind.

2. Description of the Related Art

Various vertical window blinds including venetian blinds, roller shades, roman shades, and the like are known. These window blinds commonly comprise a headrail, a bottom rail and a window covering material extending between them. Lift cords extend from the bottom rail into the headrail for raising and lowering the blind. The window covering material may be pleated or cellular material, woven woods or grasses or roman shade material that is raised and lowered or slats on ladders that can be raised and lowered as well as tilted for light control.

One popular type of window covering is the roll-up shade. This shade has a single panel of window covering material attached at its top edge to a headrail. Two or more looped cords extend from the headrail down one side of the panel of window covering material, around the bottom edge of the panel and up an opposite side of the panel of window covering material into the headrail. The cords may then pass through a cord lock in the headrail or wind around a cord collector within the headrail. Movement of the cords into the headrail will cause the panel of window covering material to roll-up and movement of the cords out of the headrail will cause the window covering material to unroll. It is quite common to use woven woods or grasses as the panel in a roll-up shade. An example of this type of shade is disclosed in U.S. Pat. No. 6,860,312 to Judkins.

A venetian blind provides the widest range of light control. The slats can be raised to a fully open position, lowered to cover the entire window and tilted vertically to a fully closed position or lowered to a fully lowered or partially lowered position with the slats tilted at a selected orientation between vertical and horizontal. Roll-up, roman, pleated and cellular shades have a softer appearance than venetian blinds. However, a conventional roll-up shade, roman shade and other fabric shades can only be raised and lowered to cover all or a portion of the window. When any of these shades is in a fully lowered or partially lowered position, the shade cannot be controlled or adjusted to change the amount of light transmittance as occurs when one tilts the slats in a fully lowered or partially lowered venetian blind.

Although the slats in most venetian blinds are wood, aluminum or plastic, it is known to make fabric slats. One example of a fabric slat is disclosed in U.S. Pat. No. 5,829,506 to Zorbas. Woven woods and woven grasses have been used for venetian blind slats, but are seldom seen in the marketplace. Venetian blind slats usually are not greater than two inches in width. Small widths of woven woods and woven grasses are difficult to work with and can come apart more easily than a panel of these materials such as are used in roll-up and roman shades. Like wood, aluminum and plastic slats, fabric slats are hung on ladders or attached to ladder rungs and may have transverse stiffeners. Venetian blinds having fabric slats operate in the same manner as venetian blinds having wood, aluminum or plastic slats.

There is a need for a window covering that has wide range of light control available in a venetian blind coupled with the softer appearance that can be achieved in a roll-up shade and in which the window covering material can be a woven wood or woven grasses.

SUMMARY OF THE INVENTION

We provide a window covering having a headrail, a plurality of shade elements, each having a first longitudinal edge and a second longitudinal edge. The shade elements are positioned sequentially below the headrail, and each shade element is made of a window covering material that can be rolled about the first longitudinal edge. We prefer to make each shade element a woven wood. A bottom rail may be positioned below the headrail and the plurality of shade elements. A first rail extends from the headrail past the first longitudinal edge of each shade element and is connected to lowermost shade element or the bottom rail. A second rail extends from the headrail and is attached to lowermost shade element or the bottom rail and to the second longitudinal edge of each shade element. Rungs extend between the first rail and the second rail such that there is one rung below and corresponding to each shade element. The first longitudinal edge of each shade element rests upon a corresponding rung when the window covering is in a closed position. A control mechanism is connected to the first rail and is capable of moving the first rail relative to the second rail. Such relative movement causes each of the plurality of shade elements to roll or unroll about the first longitudinal edge of the shade element.

The plurality of shade elements may be woven fabrics, non-woven fabrics, films, woven woods or woven grasses. We prefer to provide a stiffening bar or rod on each shade element adjacent the first longitudinal edge. This stiffener assists in causing the shade element to roll about the first longitudinal edge. For some materials such as woven woods the stiffener could be a length of tape that joins two or more pieces of wood or grass together.

The control mechanism may be a cord lock attached to the headrail and through which a cord attached to the first rail passes or a shaft within the headrail on which the first rail is wound.

One could provide a valance on the headrail. The valance could be made of the same material as the shade elements or a different material could be used. The valance could be configured so that the lower edge of the valance may be raised.

Other objects and advantages of the present window covering will become apparent from certain present preferred embodiments thereof shown in the drawings.

DETAILED DESCRIPTION OF THE INVENTION

Figure 1:
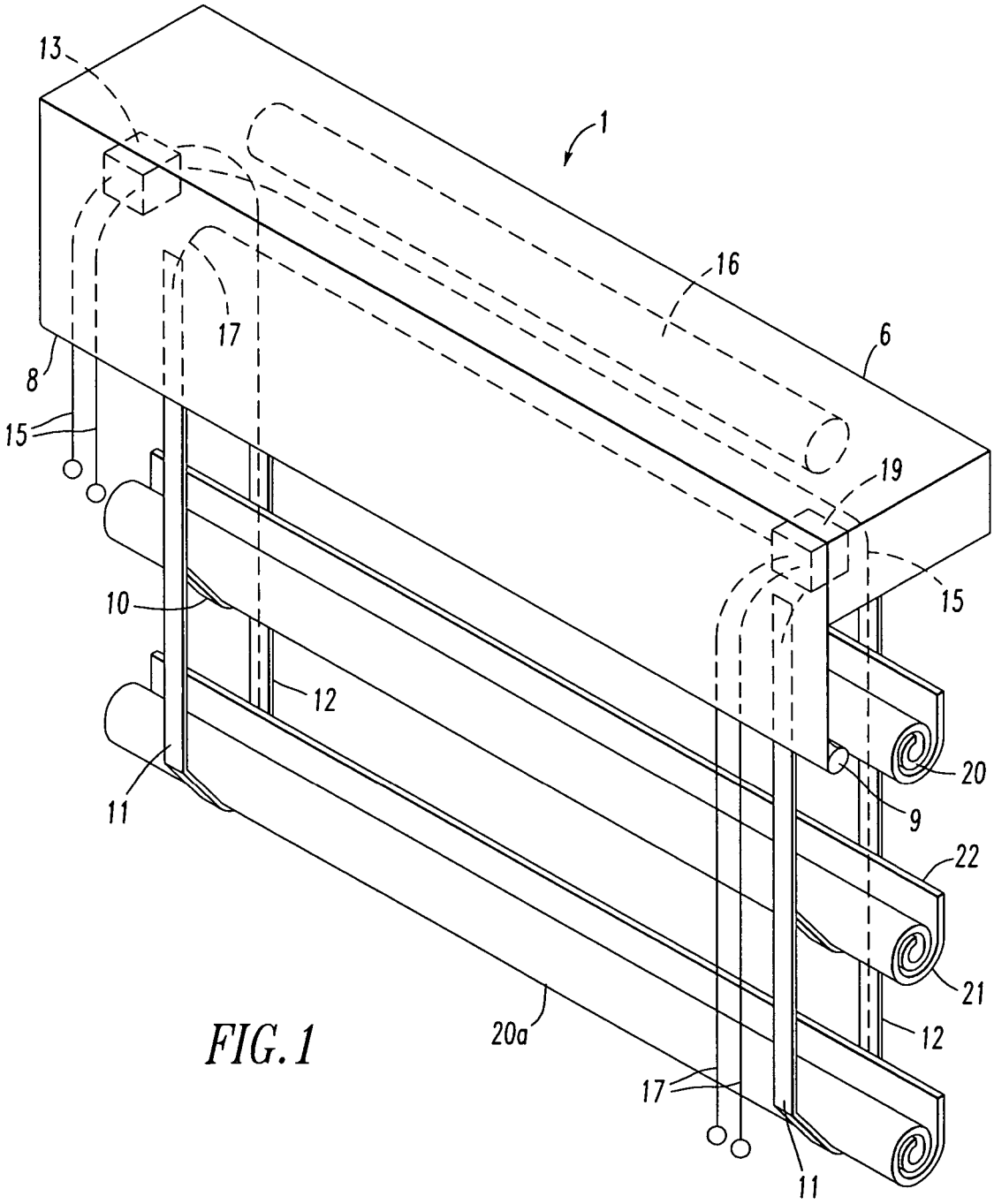
FIG. 1 is a front perspective view of a first preferred embodiment of our window covering in a fully lowered, fully open position.
Figure 2:
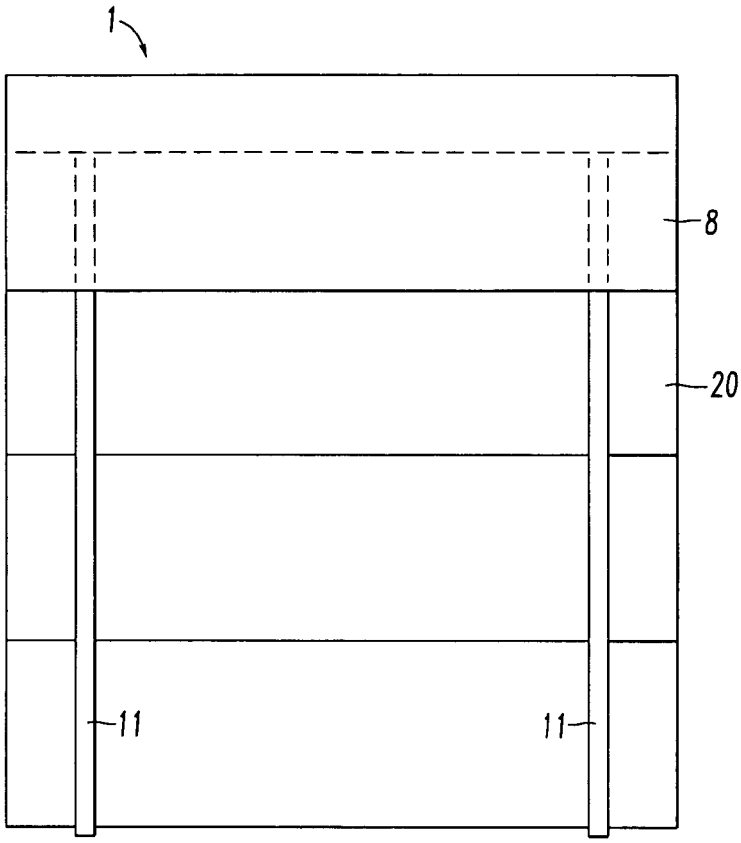
FIG. 2 is a front view of the embodiment of FIG. 1 in a fully lowered, fully closed position.
Figure 3:
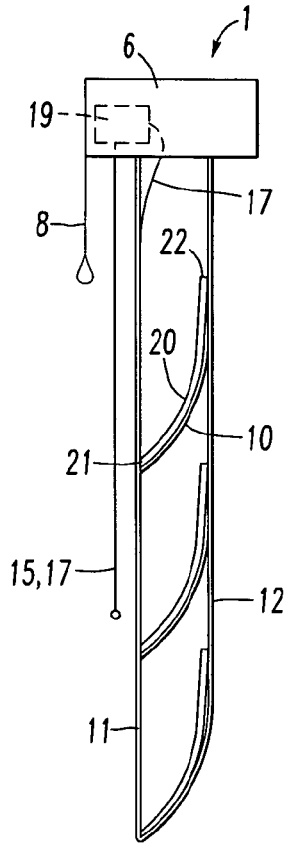
FIG. 3 is a side view of the embodiment of FIGS. 1 and 2 in a fully lowered, fully closed position.
Figure 4:
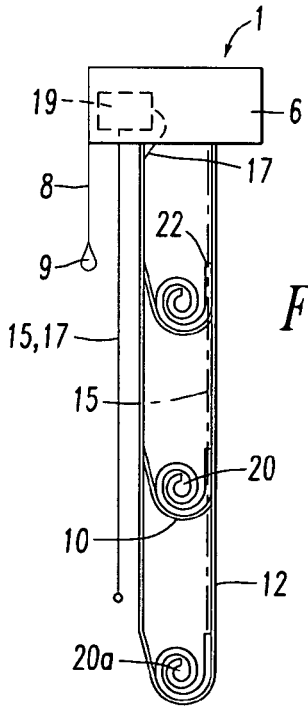
FIG. 4 is a side view similar to FIG. 3 showing the window covering in a fully lowered, fully open position.

A first present preferred embodiment of our window covering 1, shown in FIGS. 1 thru 6 has a headrail 6, and a plurality of shade elements or shade segments 20 positioned sequentially below the headrail. Every shade element has a length and a width, the length being greater than the width, a first longitudinal edge 21 and a second longitudinal edge 22. Two first rails 11 extend from the bottom rail past the first longitudinal edge of the shade elements and are attached to the headrail. Two second rails 12 are attached to the second longitudinal edge 22 of each shade element and between the bottom rail into the headrail. The rails could be any material that has been used for rails in ladders for venetian blinds including polyester cord or fabric tape. Rungs 10 extend between the rails 11 and 12. Two lift cords 15 extend from the lowermost shade element 20*a* into the headrail where they pass through a cord lock 13. The lift cords could be on either side of the rails 12, but are shown in dotted line near rails 12 so that they may be seen more easily in the drawings. The lift cords 15 raise and lower the shade elements 20 in much the same manner as lift cords in a venetian blind raise and lower the slats. A tilt or roll-up cord 17 is attached to the upper end of each first rail 111 and passes through a second cord lock 19. Pulling these cords lifts the first rails. The relative movement of the first rails 11 relative to the non-moving second rails 12 causes the shade elements to roll up. If desired, one may connect the first rails 11 to a shaft 16 shown in dotted line in FIG. 1, so that rotation of the shaft would lift the rails. Alternatively, both the first rails 11 and second rails 12 could be connected to the shaft 16. Then rotation of the shaft would move both rails causing the shade elements to roll up or unroll.

The shade elements are made of any material that can be used as a window covering and that can be rolled up. We prefer to use woven woods or woven grasses. But, one could also use woven or non-woven fabric or a film.

The headrail 6 could be a box like structure of the type used for venetian blinds. In that event, the cord locks 13, 19 and shaft 16 would be within the headrail. Alternatively, the headrail could be a block of wood or other solid structure such as is frequently used for roman shades. In that headrail the cord locks 13, 19 and shaft 16 would be mounted to the bottom of the headrail.

Figure 5:
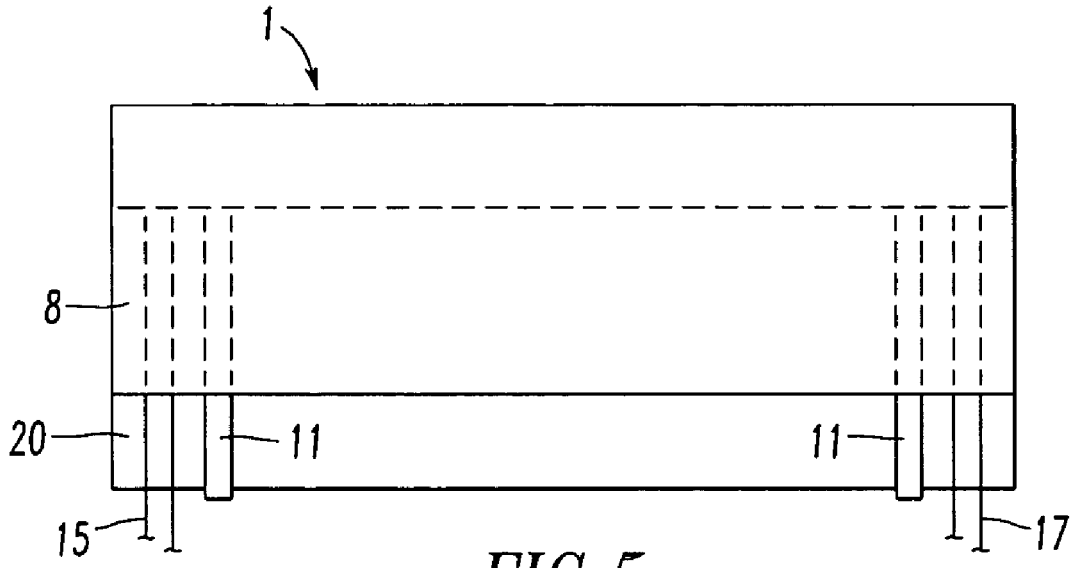
FIG. 5 is a front view of the embodiment of FIG. 1 in a fully raised position.
Figure 6:
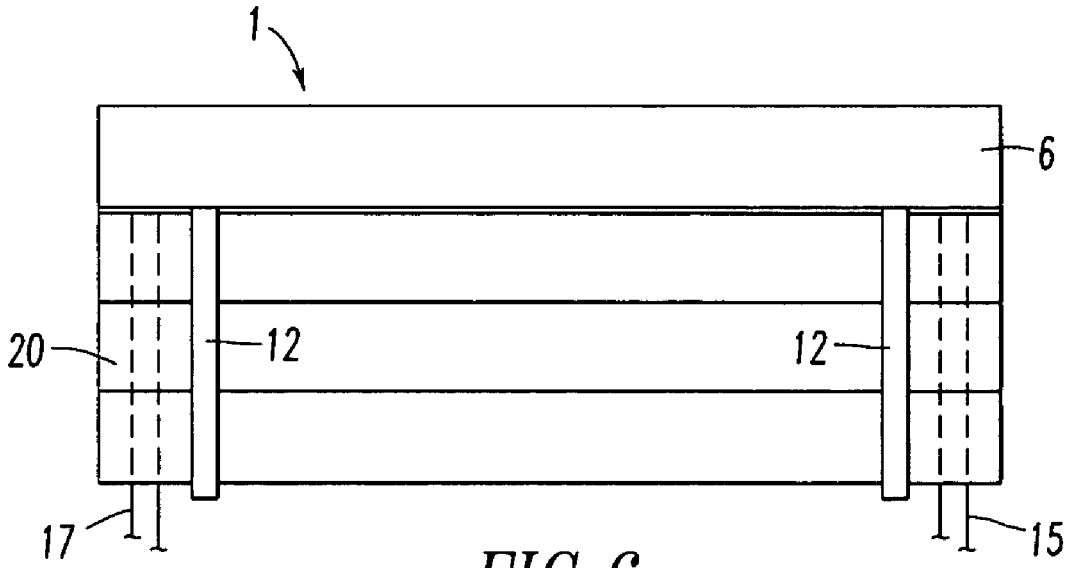
FIG. 6 is a rear view of the embodiment of FIG. 1 in a fully raised position.
Figure 7:
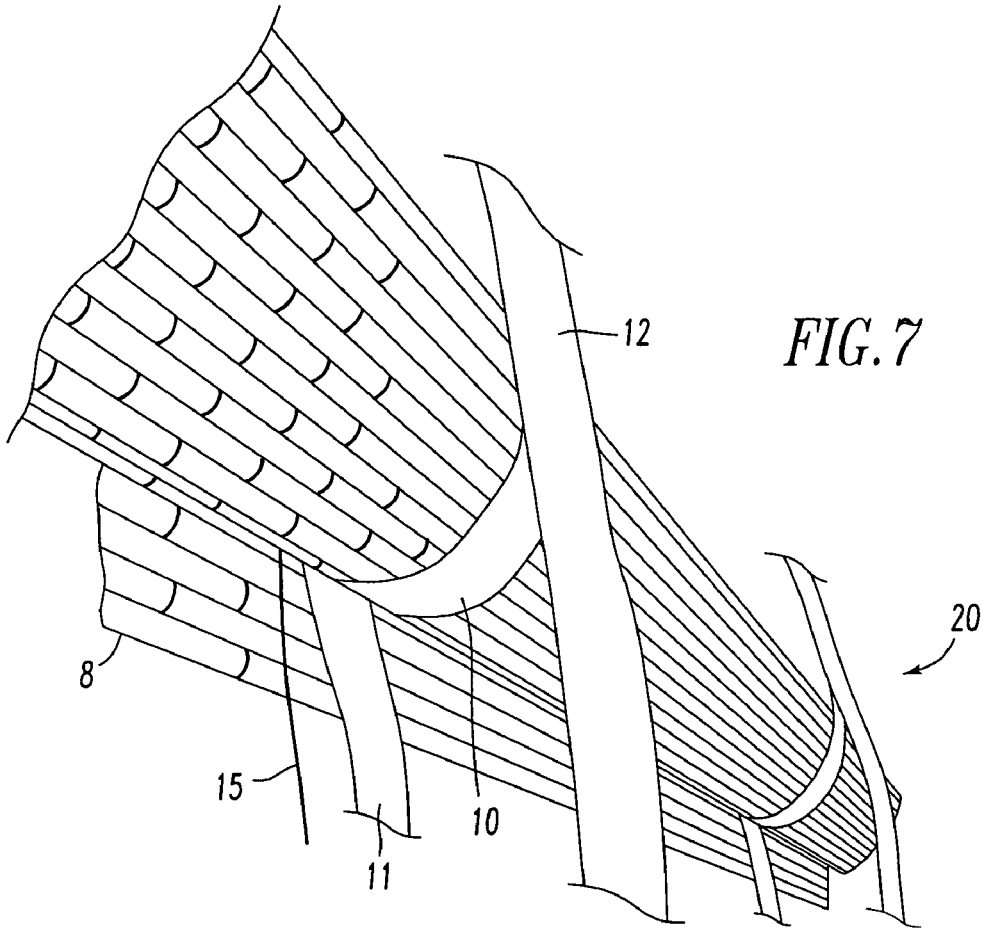
FIG. 7 is a perspective view of a portion of a woven wood shade element that could be used in the embodiment of FIG. 1 in a completely rolled-up position.
Figure 8:
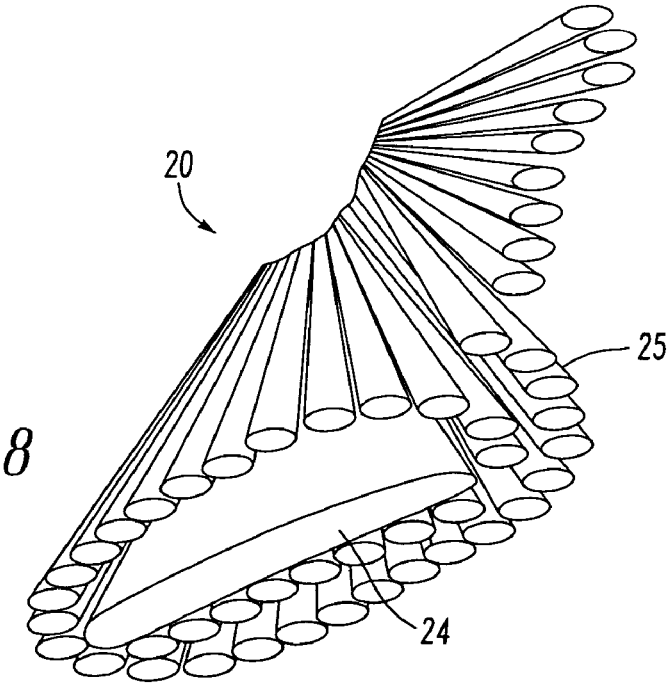
FIG. 8 is an a perspective view showing one end of the shade element shown in FIG. 8 in a partially rolled-up position.

We prefer to provide a valance 8 which covers the front of and extends from the headrail. We prefer that the valance 8 be of sufficient length so that all the shade elements 20 will be behind the valance 8 when the window covering is in a fully raised position as shown in FIGS. 5 and 6. The valance may have a pocket 9 along its lower edge in which a rod is inserted. The rod (not shown) serves as a weight keeping the valance in a fully extended position.

The roll-up action of the shade elements can best be understood from FIGS. 3, 4, 7 and 8. When the shade is in the fully lowered closed position shown in FIG. 3, each shade element 20 is positioned above a rung 10. The second longitudinal edge 22 of the shade element is attached to rails 12. The first longitudinal edge 21 is free, but rests on the rung 10. As the first rails 11 are raised relative to the second rails 12 the first longitudinal edge 21 of the shade element folds back upon the shade element. Continued movement of the first rails causes the shade elements to roll up. In the woven wood shade elements shown in FIGS. 7 and 8 we prefer to provide a fabric tape 24 adjacent the first longitudinal end of the shade element. The fabric 24 covers several of the wood sticks 25 in the shade element 20. This tape acts as a stiffener which assists in causing the shade elements to roll evenly. When the shade elements are a fabric or film we provide a stiffener along both the first longitudinal edge 21 and the second longitudinal edge 22. The stiffener may be a rod or bar in a pocket similar to the pocket 9 in the valance 8.

Figure 9:
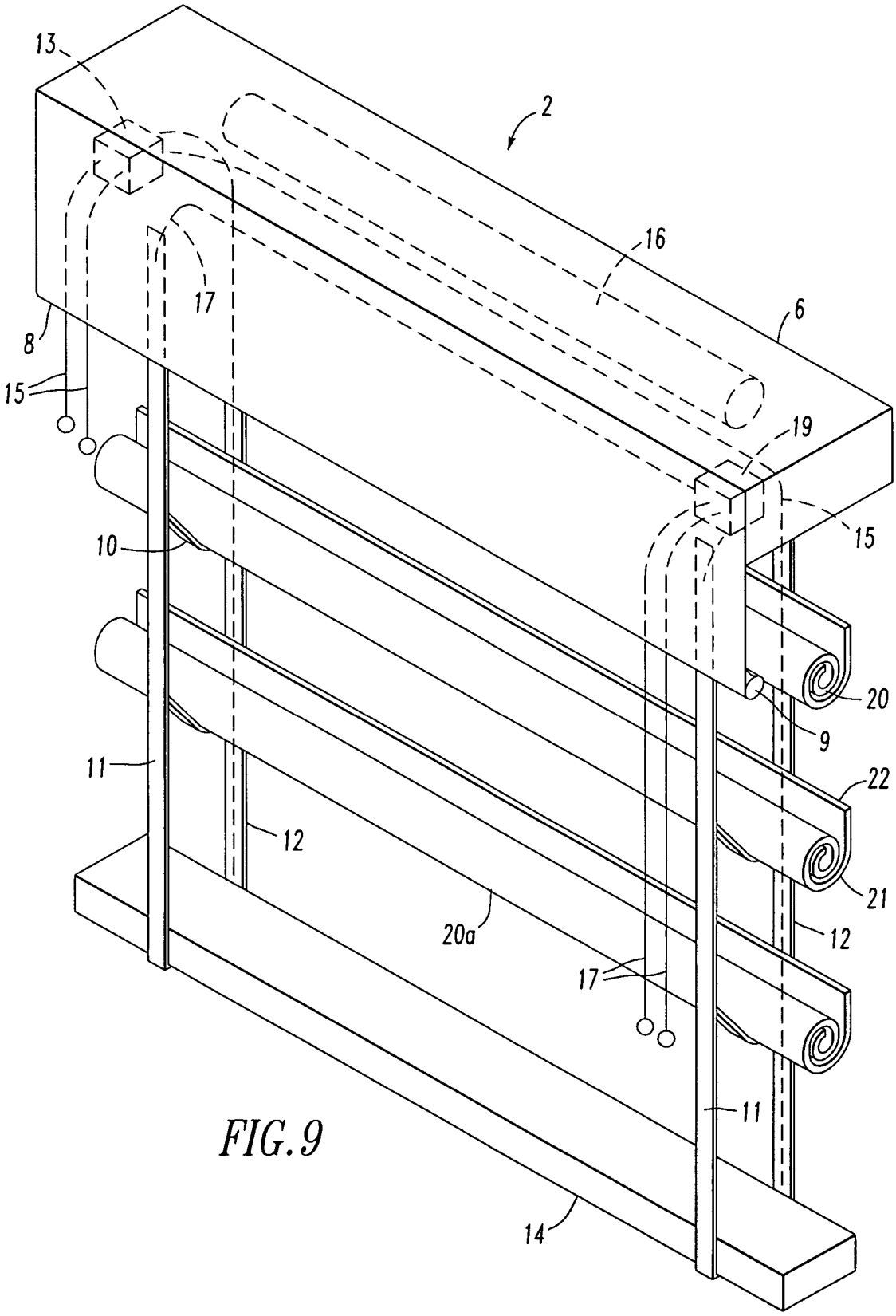
FIG. 9 is a front perspective view of a second preferred embodiment of our window covering in a fully lowered, fully open position.

A second preferred embodiment 2 is shown in FIG. 9. This embodiment is similar to the first embodiment. Indeed, the same reference numbers are used for the parts that are common to both embodiments. In this embodiment 2 a bottom rail 14 is provided. Consequently, the rails 11, 12 and lift cord 15 extend to and are attached to the bottom rail. This embodiment operates in the same manner as the first embodiment.

Figure 10:
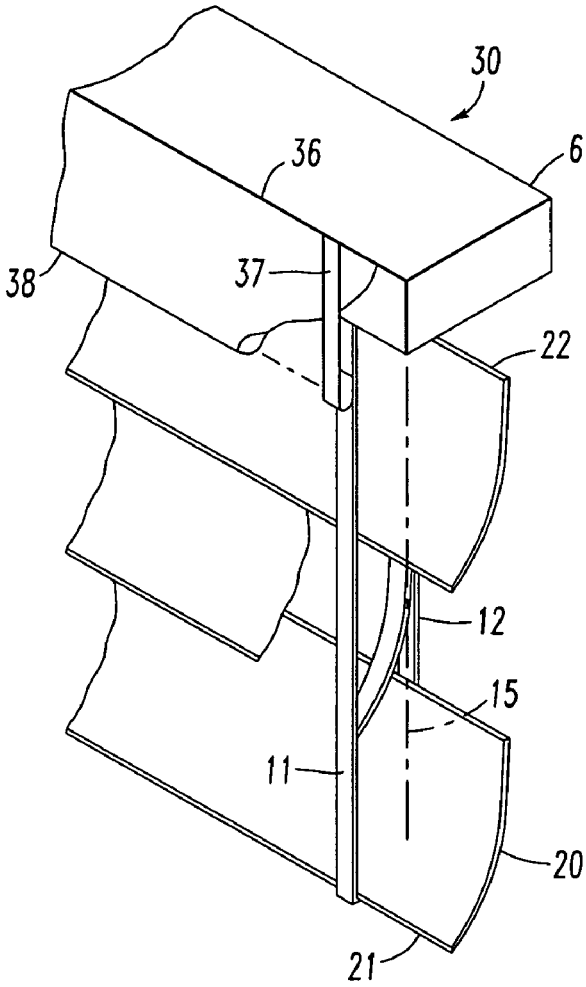
FIG. 10 is a perspective view of the upper portion of a third present preferred embodiment.

In a third embodiment shown in FIG. 10, the valance 38 is raised and lowered with the shade segments 20. As in the previous embodiments the shade segments are positioned on rungs that extend between first rails 111 and second rails 12. The first longitudinal edge 21 of the shade segment is free and the second longitudinal edge 22 of the shade segment is attached to rail 12. In this embodiment a looped tape or cord 37 is attached to the upper edge 36 of the valance which in turn is attached to headrail 6. The opposite end of the cord or tape 37 is attached to rail 11. Thus, as rail 11 is raised or lowered the attached end of loop cord or tape 37 is raised or lowered. As a result, valance 38 is rolled up as the shade segments 20 are being rolled up and unrolled as the shade segments are unrolled.

Figure 11:
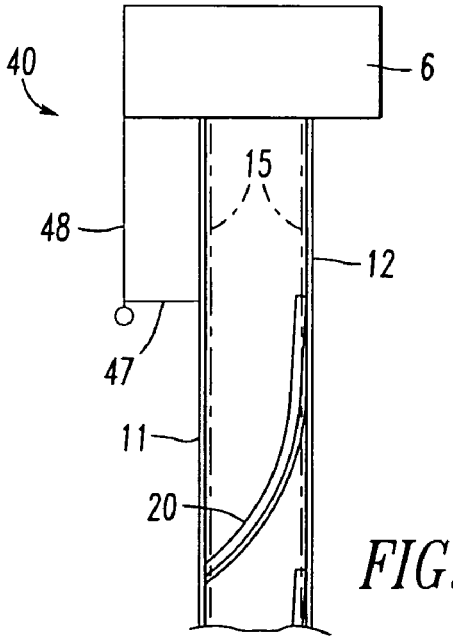
FIG. 11 is a side view of an upper portion of a fourth present preferred embodiment.

In yet another embodiment 40 shown in FIG. 11 a cord 47 connects the lower edge of valance 48 to the first rail 11. One such cord would be provided at the location of each first rail 11. Consequently, as the first rail 11 is raised the lower edge of the valance is pulled upward by cord 47. Moving the first rail down would lower the valance.

Although we have described and shown certain present preferred embodiments of our window covering, it is to be distinctly understood that the invention is not limited thereto but may be variously embodied within the scope of the following claims.

We claim:

1. A window covering comprising:

a headrail;

a plurality of shade elements, each and every shade element having a length and a width, the length being greater than the width, a first longitudinal edge and a second longitudinal edge, the shade elements positioned sequentially below the headrail, each shade element comprised of a window covering material that can be rolled about the first longitudinal edge;

a first rail extending from the headrail and being adjacent the first longitudinal edge of each shade element;

a second rail extending from the headrail and attached to the second longitudinal edge of each shade element;

a plurality of rungs attached between the first rail and the second rail such that there is one rung below and corresponding to each shade element, the first longitudinal edge of each shade element resting upon a corresponding rung when the window covering is in a closed position;

a control mechanism connected to the first rail and capable of moving the first rail relative to the second rail, such relative movement causing each of the plurality of shade elements to roll or unroll about the first longitudinal edge of that shade element.

2. The window covering claim 1 also comprising at least one lift cord extending from a lowermost shade element to the headrail.

3. The window covering of claim 1 also comprising at least one additional rail attached to the second longitudinal edge of each shade element.

4. The window covering of claim 1 also comprising a plurality of stiffeners, one stiffener attached to each shade element adjacent the first longitudinal edge of the shade element.

5. The window covering of claim 4 wherein the stiffener is a rod or a bar.

6. The window covering of claim 1 wherein the control mechanism is comprised of a cord lock attached to the headrail and at least one tilt cord passing through the cord lock, the at least one tilt cord being attached to the first rail.

7. The window covering of claim 1 wherein the control mechanism is comprised of a shaft within the headrail on which the first rail is wound.

8. The window covering of claim 7 wherein the second rail is connected to and can wind around the shaft.

9. The window covering of claim 7 also comprising at least one spool on the shaft on which at least one of the first rail and the second rail is wound.

10. The window covering of claim 1 wherein the plurality of shade elements are each comprised of a material selected from the group consisting of woven fabrics, non-woven fabrics, films, woven woods and woven grasses.

11. The window covering of claim 1 wherein at least one of the first rail and the second rail are a tape or a strip of fabric.

12. The window covering of claim 1 also comprising a valance attached to the headrail.

13. The window covering of claim 12 also comprising a connecting cord having one end attached to the valance and an opposite end attached to the first rail.

14. The window covering of claim 12 the valance having an upper edge attached to the headrail, a front surface and a lower edge, also comprising a cord loop having one end attached to the upper edge of the valance extending over the first surface, past the lower edge and attached to the first rail.

15. The window covering of claim 1 also comprising a bottomrail to which the first rail and second rail are attached.

16. The window covering of claim 15 also comprising at least one lift cord extending from the bottomrail to the headrail.

17. The window covering of claim 1 wherein the headrail is a rectangular solid structure.

* * * * *